United States Patent [19]

Sallee

[11] 4,300,451

[45] Nov. 17, 1981

[54] METHOD AND APPARATUS FOR MEASURING PNEUMATIC DIFFERENTIAL DRAG FORCES

[75] Inventor: Bradley T. Sallee, Austin, Tex.

[73] Assignee: Tracor, Inc., Austin, Tex.

[21] Appl. No.: 914,450

[22] Filed: Jun. 12, 1978

[51] Int. Cl.[3] ..... F42C 5/00

[52] U.S. Cl. ..... 102/223; 102/228; 102/263

[58] Field of Search ..... 102/224, 223, 263, 228, 102/229

[56] References Cited

U.S. PATENT DOCUMENTS

| | | | |
|---|---|---|---|
| 2,513,185 | 6/1950 | Lauritsen | 102/229 |
| 3,675,579 | 7/1972 | Min | 102/263 X |
| 3,750,590 | 8/1973 | Fisher | 102/263 X |
| 3,802,344 | 4/1974 | Laipple | 102/229 |
| 3,841,220 | 10/1974 | Murphy | 102/263 |
| 3,962,974 | 6/1976 | Anderson et al. | 102/228 |
| 3,968,751 | 7/1976 | Palifka | 102/228 |
| 3,974,773 | 8/1976 | Rongus | 102/224 |
| 3,981,239 | 9/1976 | Czajkowski et al. | 102/229 X |
| 3,992,999 | 11/1976 | Chevrier et al. | 102/230 |
| 4,015,533 | 4/1977 | Hermanson | 102/229 |

*Primary Examiner*—David H. Brown
*Attorney, Agent, or Firm*—Arnold, White & Durkee

[57] ABSTRACT

A differential drag apparatus is disclosed for detecting air pressure forces on a drag-sensing body. The body is movable in response to a predetermined magnitude of air pressure force. A pressure regulator responds to the movement of the body by releasing uniform pressure to an activation system. The activation system in turn releases a trigger provided the air pressure force acting against the drag-sensing body remains above the predetermined magnitude for a predetermined length of time. The trigger upon release may perform any number of activates such as opening or closing an electrical circuit, initiating a mechanical response, i.e. releasing a parachute, or detonating a small munition charge. The detonation of a charge, for example, may in turn ignite a rocket motor, release an explosive, or any other of related activities. The apparatus is insensitive to short duration forces above or below the predetermined magnitude, and radiation as results from proximate nuclear blast. The trigger and regulator are initially primed by a pyro-train fuse; yet, activated only by differential movement of the drag-sensing body for a predetermined length of time.

13 Claims, 6 Drawing Figures

METHOD AND APPARATUS FOR MEASURING PNEUMATIC DIFFERENTIAL DRAG FORCES

BACKGROUND OF THE INVENTION

This invention relates to a pneumatic differential drag force detector which responds to a predetermined magnitude of force over a sustained duration by releasing a signal which in turn activates a specified activity. More particularly, this invention relates to a pneumatic differential drag force detector which is adaptable to the head of an unarmed decoy missile for detecting air pressure forces on re-entry of the missile into the earth's atmosphere and for responding to the force of a predetermined magnitude for a sustained duration by igniting a rocket motor or related activity.

Various methods have been disclosed in the prior art for detonating a firing assembly which would in turn discharge a munition explosive. Missiles and related airborne artillery equipment are frequently activated directly or indirectly by means of air pressure forces. Ram air pressure routed through a conduit system is known for arming a munition. Murphy, U.S. Pat. No. 3,841,220, and Rongus, U.S. Pat. No. 3,974,773. Pneumatic or fluid pressure has also been used to arm a firing system powered by a coiled-spring. Czajkowski et al. U.S. Pat. No. 3,981,329, Hermanson, U.S. Pat. No. 4,015,533, and Anderson et al. U.S. Pat. No. 3,962,974.

In the case of atomic warheads, the missile is often traveling at an altitude of 200,000–300,000 feet. The air pressure at this altitude on a sensor several inches in diameter, even at very high velocities, is only on the order of a few grams. As the missile descends, the air pressure increases. At a predetermined point the ignition of a rocket motor or related activity is desirable. Therefore, a very sensitive and durable drag-sensing body is required to detect small forces above a predetermined magnitude and initiate a response due to that detection. At the same time, the drag-sensing body must be capable of withstanding proximate nuclear blasts—defined as nuclear hardness. The sensor system must filter out short duration forces above the predetermined magnitude which will move the body. Only a force above the predetermined magnitude which remains for a predetermined length of time must activate the system.

The detonation on the firing assembly via signals from a sensor may initiate a number of activities other than discharging an explosive. For example, it may activate a relay which controls the ascension or descension of a craft. It may also ignite a rocket motor as noted above. In Chevrier et al. U.S. Pat. No. 3,992,999, a barometer is used to trigger a firing assembly which releases a parachute. It is obvious to those skilled in the art that may types of activities may be initiated by discharging a firing system.

It has been a particular problem, however, to develop a sensitive and durable sensing device which can remain inoperable for an indefinite length of time yet activated on a short time notice with assured reliability of performance. The prior art is complicated by a plurality of mechanical components which significantly inhibit their ability to remain inoperative for extended lengths of time. Achieving an accurate degree of sensitivity has also posed a particular problem in the field. As discussed above, the force from air pressure is generally on the order of only a few grams at the high altitudes traveled by atomic warhead missiles. While it is very important that the sensing means correctly monitors the environment, it is particularly important that the sensing device be inoperative to short duration forces such as proximate atomic blasts which may artificially release the trigger in conventional detonators.

An additional problem in the art has been the availability of an activation system responsive to sensing means which operates with a minimum amount of mechanical components. Again there is the need for an activation system capable of remaining inoperative for an indefinite lengths of time. The prior art is complicated by a plurality lock stems, shear pins, O-rings, etc.

There is a need, therefore, for an efficient, accurate, durable and reliable sensor and activation system responsive to environmental conditions for activation of a firing assembly thereby discharging a munition explosive, rocket motor, or related activities.

The problems enumerated in the foregoing are not intended to be exhaustive but rather are among many which tend to impair the effectiveness of the prior art at the high altitudes and speed concerned. Other noteworthy problems may also exist; however, those presented above should be sufficient to demonstrate that the present art available to users of a sensing and detonating device has not been altogether satisfactory.

SUMMARY OF THE INVENTION

The invention relates to a novel method and apparatus for detecting pneumatic differential drag forces resulting from air pressure on a drag-sensing body and responding to the movement of the body due to the air pressure with a preestablished activity. While the invention will be disclosed in terms of detonating a primer which ignites a rocket motor on an unarmed decoy missile, it will be obvious that the differential drag detector may be installed on any type of moving body to initiate any number of activities such as opening or closing an electrical circuit, initiating a mechanical or hydraulic operation, i.e. depressing a brake, turning a valve, etc.

The invention comprises a sensor means, a trigger, a pressure regulator, and an activation system. The sensor means includes a drag-sensing body exposed to a continuous flow of air. The sensor means is connected to the pressure regulator. The regulator supplies uniform pressure to the activation system from a high pressure source in response to movement of the drag-sensing body. The activation system comprises a bellows chamber for receiving the uniform pressure from the regulator. A pressure relief outlet is attached to the bellows permitting the escape of the uniform pressure from the bellows at a predetermined rate. If the drag-sensing body is displaced for a predetermined length of time, the rate of uniform pressure released into the bellows of the activation system is greater than may escape through the pressure relief outlet. This results in the expansion of the bellows. An activation piston, mounted within the bellows, is displaced with the expansion of the bellows. The trigger, hereafter referred to as the firing assembly, includes a spring-biased firing piston. Prior to expansion of the bellows, the activation piston restrains the firing piston from striking a primer thereby initiating the desired activity. With displacement of the activation piston, the firing piston is no longer restrained. With respects to the disclosure, the activity disclosed is the ignition of a pyro-conduit igniting a rocket motor. However, the invention may perform any number of activities as noted above.

Due to the nature of military missiles, the invention must be capable of remaining inoperative for extended periods of time. However, the system must be primed prior to detonetion. The priming stage serves not only as a means to permit the activation but also as a check on the operation of the missile after prolonged inactiveness. The priming system engages the firing assembly and activates the regulator by means of a pyro-train or prima-cord. A pyro-train is well-known within the art as a fast velocity firing fuse. It is often constructed of an outer lead sheath housing enclosing a plastic explosive. The train has a very high firing rate on the order of 1,000 feet per second. A pyro-train is particularly suitable to high velocity missiles and related airborne systems due to severe environmental conditions during flight. Proximate nuclear blasts can easily damage an electrical transmitting system. Whereas, a high velocity firing fuse exploding within a protected lead sheath is particularly invulnerable to environmental factors. When the pyro-train is looped together within an enclosure, the resulting explosion exerts a very high pressure which may be used to drive a piston forward if one wall of the enclosure is the head of the piston. In the case of the firing assembly, an internal hollow shaft which houses the firing piston is advanced forward by the explosion of a loop of the pyro-train fuse within the assembly compressing a coiled spring which in turn releases a detent thereby preventing the shaft from returning to its original released position. In this manner, the firing piston is placed under spring pressure ready for detonation of the primer restrained only by the activation piston. Concurrently, the priming system laterally displaces a needle piston mounted within the regulator away from a hermetical seal thereby releasing high pneumatic pressure from a source into the regulator. High pressure enters the regulator and is confined with a regulating chamber, comprised of a bellows. The regulating chamber is under compressive force from a coil spring. An equalized or uniform pressure condition results between the pneumatic pressure confined within the bellows and the coil spring. The needle piston is initially displaced from the hermetical seal by an explosion of a pyro-train loop within an enclosure of the regulator.

The sensor means is equipped with a dampening spring which overcomes forces below a predetermined magnitude. Whenever a drag force above the predetermined magnitude is detected by the drag-sensing body, it is displaced relative to the transporting body thereby releasing the uniform pressure from the regulator chamber into the bellows of the activation system. If the drag force continues for a predetermined length of time, the amount of uniform pressure released into the bellows will displace the activation piston within the bellows. In this manner, the second detent attached to the activation piston releases the firing piston permitting the firing pin free access to the primer.

It is, therefore, a general object of the invention to provide a novel method and apparatus for sensing environmental conditions and responding to a predetermined magnitude of air pressure force lasting for a predetermined length of time by releasing a trigger resulting in the performance of a specified activity.

Examples of the more important features of the invention have been summarized rather broadly in order that the description which follows may be better understood and in order that the contribution to the art may be better appreciated. There are, of course, additional features of applicant's invention which may be described hereinafter and which will also form the subject of the claims appended hereto.

BRIEF DESCRIPTION OF THE DRAWINGS

In order that the manner in which the recited features, advantages, and objectives of the invention, which will become apparent, are evident and can be understood in detail, a better description of the invention, briefly summarized above, may be had by a reference to the embodiments which are illustrated in the appended drawings and form a part of the specification.

It shall be noted that the appended drawings are not to be considered limiting the scope of the invention, for the invention may admit to other equally effective embodiments without departing from its spirit and scope.

In the drawings:

FIG. 1 illustrates a drag-sensing body connected to a decoy missile.

FIG. 2 illustrates a schematic view of the invention illustrating the sensor means, pressure regulator, firing assembly, priming system, and activation system.

FIG. 3 is a detail of the pressure regulator.

FIG. 4 is a detail of a firing assembly and activation system.

FIG. 5 is a schematic view of the firing assembly in a primed position after engagement by the priming system and pressure equalization within the regulator after lateral displacement of the needle piston.

FIG. 6 illustrates the release of pneumatic pressure from the sensor valve displacing the activation piston thereby releasing the firing piston.

DETAILED DESCRIPTION OF THE PREFERRED EMBODIMENT

Figures 1, 2:
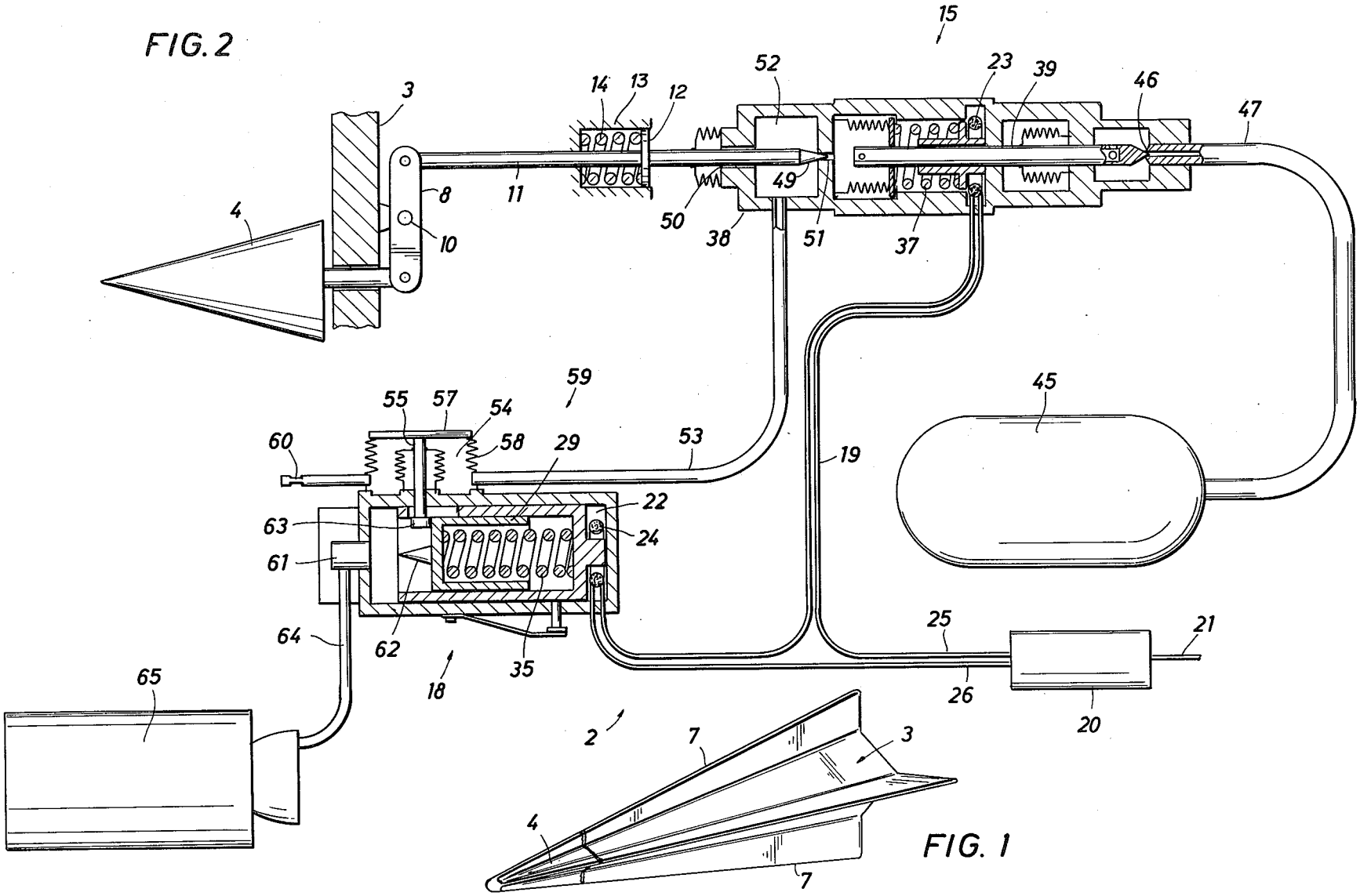

Referring to FIG. 1, the invention is a pneumatic differential drag apparatus which includes a drag-sensing body 4 connected to a transporting body 3. The body 4 is a cone shaped element connected in spaced relationship to the front of the main body of a missile. As described in greater detail below, the drag-sensing body 4 is displaceable relative to the transporting body 3. A space is provided for between the bodies 3 and 4 to permit relative movement. Since the drag-sensing body 4 is supported on the front end of the transporting body 3 and acts as a nose cone for the missile, the body 3 will sense maximum air-pressure forces during flight. Applicant developed the invention for use on an unarmed decoy missile in a war-time application to confuse the enemy as to which incoming missiles to destroy via a missile-to-missile defense system. Applicant recommends the use of fins 7 in the missile's aero-dynamic configuration for improved performance in simulating an armed nuclear warhead missile. However, the development of the decoy missile system and the characteristics coherent in its operation is not a part of this invention. The body 4 which is also illustrated with fins 7 need not have fins to perform satisfactorly with respect to the entire invention. Indeed, the body 4 need not be cone shaped. A bullet shape or flat end face would be permissible. In assessing which shape to use, the streamline profile of the body must be considered in evaluating its affect on the level of sensitivity. A flat end face body will respond to a lower level of air pressure than a streamlined geometric body would. However, as discussed in greater detail below, an activation system may be adjusted to accommodate the different responses of various geometric shapes by altering the sizes of various components within the system which control response time. As noted above, the application of this invention is not limited to differential drag sensing at the head of a missile. The invention has application in detecting differential drag forces on any type of moving body such as an automobile, airplane, boat, train, or the like with the resulting initiation of a specified activity when an air pressure force of a predetermined magnitude is detected for a sustained period of time.

Referring to FIG. 2, an apparatus 2 is shown schematically in its entirety. The drag-sensing body 4, is connected to a mechanical linkage 8 which in turn connects with a rod 11. As noted above, the body 4 is used to measure differential movement relative to the transporting body 3. A preloaded dampening spring 14 is secured within a housing 13 and restrained by a plate 12 which is attached to the rod 11. Rod 11 continues through aperture 50 into compartment 52 of a sensor valve 38. The tip 49 of rod 11 securely seals aperture 51 when in a relaxed position. The mechanical linkage 8 is secured to the transporting body 3 by a pin 10. Lateral displacement of the body 4 to the right with respect to the transporting body 3 displaces the tip 49 of rod 11 to the left thereby allowing pressure to escape from a regulator 15 through aperture 51. The dampening spring 14 prevents the lateral movement of rod 11 to the left until sufficient force is exerted to overcome the spring 14. In this manner, a predetermined level of magnitude is established below which the body 4 is insensitive to movement.

Pyro-trains are commonly used in high speed missiles and airborne artillery. As noted above electrical engaging systems often fail due to the severe environmental factors associated with war time use. A pyro-train 19 as shown in FIG. 1 is connected to a pyro-manifold 20 which in turn is attached to a pyro-input 21. The pyro-train 19 is looped within a firing assembly 18. Pyro-train 19 exits the firing assembly 18 after completing the loop within compartment 22 and continues to the pressure regulator 15. Pyro-train 19 is again looped within the pressure regulator 15, as will be described in detail below, and exits the regulator 15 continuing back to the manifold 20. In this manner, the ignition of both pyro-train leads 25 and 26 at manifold 20 is assured to ignite the pyro-train loop and, therefore, the explosive loops within the firing assembly 18 and pressure regulator 15. If either lead 25 or 26 of pyro-train 19 fails to ignite, the circuit will still be complete with the ignition of merely one lead.

Figure 3:
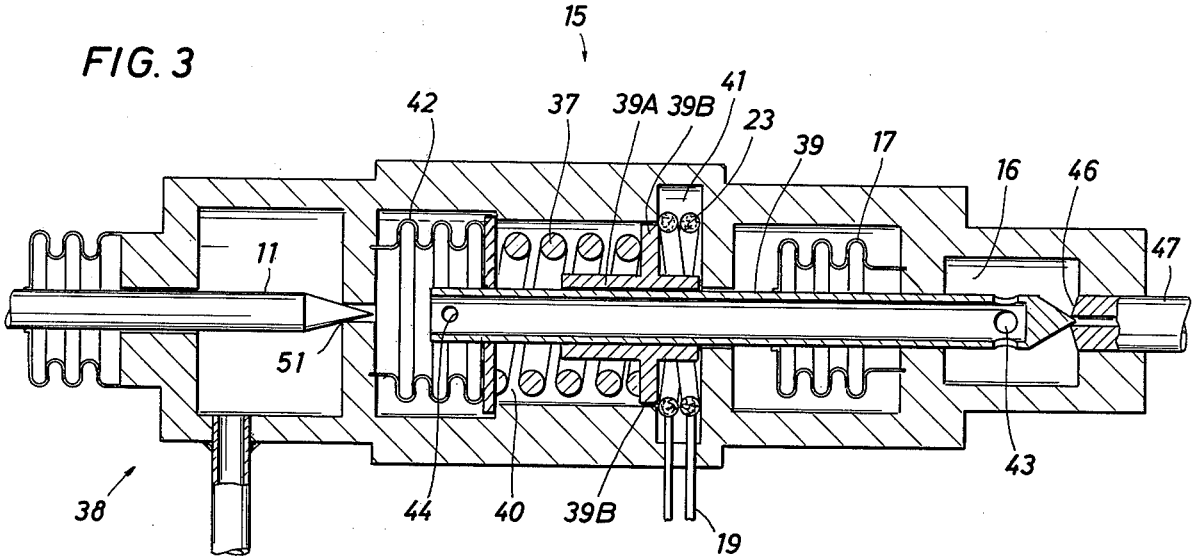

As shown in FIG. 3, the pressure regulator 15 equalizes the high pressure from a high pressure source 45 and releases a uniform pressure. The pressure regulator 15 includes a needle piston 39 and a support tube 39A. The needle piston 39 is laterally displacable within the support tube 39A and performs a sealing function by preventing the admission of high pressure from a conduit 47 into a compartment 16. Pyro-train 19 enters and loops around within compartment 41. After forming the loop, pyro-train 19 exits compartment 41 returning to pyro-manifold 20 thereby creating a continuous loop as described above. With the ignition of pyro-train 19 and the subsequent explosion of loop 23 within compartment 41, the tube 39A is laterally displaced to the left compressing a coil spring 37. The coil spring 37 is restrained between a bellows 42 and a lip 39B of tube 39A. The needle piston 39 is anchored within the bellows 42. The bellows 42 does not provide a rigid base for the coil spring 37. When the tube 39A is initially displaced by the explosion of loop 23, the spring 37 retracts compressing bellows 42. Since the needle piston 39 is anchored within the bellows 42, the needle 39 is laterally displaced from a sealing or first position to a retraced or second position left of the first position. When retracted to the second position, high pressure is permitted to enter the compartment 16. In the prototype, the pressure within the high pressure source was 2000 psig. The value of the uniform pressure was 90 psig. In this manner, a large supply of pressure will provide an extremely long supply of uniform pressure. The bellows 42 is secured within regulator 15 and is in communication with a sensor valve 38 via aperture 51. As noted above, however, the rod 11 is held firmly against aperture 51 whenever the body 4 is in a relaxed position. The bellows 42 also serves a sealing purpose by preventing loss of pneumatic pressure from within bellows 42 into compartment 40. Before igniting pyro-train 19, the needle piston 39 is seated in an air-tight manner against a hermetical seal 46. The seal 46 is connected to a conduit 47 which is in communication with the high pressure pneumatic source 45. The seal 46, therefore, is at the input port of the high pressure fluid entering the compartment 16. As the needle piston 39 is displaced to the left by means of the explosion of the pyro-train loop 23 or expansion of coil spring 37, high pneumatic pressure is allowed to enter compartment 16. A bellows 17 is adjacent and open to compartment 16. Bellows 17 prevents the leakage of the pneumatic pressure along the surface of the needle 39. High pressure fluid enters holes 43 of the needle piston 39 and moves along the interior of the needle piston 39. The pressure exits needle piston 39 via holes 44 into bellows 42. With the explosion of loop 23 within compartment 41, the tube 39A forces the spring 37 and the bellows 42 to the left. High pressure enters compartment 16 and travels to bellows 42 which in turn forces spring 37 to the right. In this manner, the pressure inside the bellows 42 and the force exerted by the spring 37 are equivalent. As the pressure in bellows 42 decreases, spring 37 compresses bellows 42 thereby moving needle piston 39 to the left and allowing more high pressure to enter bellows 42. The pressure within bellows 42 will always equal the force exerted by spring 37. Hence, an equalizing condition has resulted with the generation of uniform pressure within the bellows 42 also referred to as the regulating chamber. The explosion of pyro-train loop 23 releases the needle piston 39 from the hermetical seal 46. The needle piston 39 is initially hermetically sealed such that the compressive force of the spring 37 against the bellows 42 and the lip 39B in an inactive state is less than the force required to break the seal between needle piston 39 and seal 46. An outside force is required to initially break the seal as provided by explosive loop 23. A hermetical seal is provided to prevent the slow leakage of pressure from the source 45 over a long period of time. The missile which houses this invention may remain inactive for many years before the source is checked. It is important, therefore, to seal the source thoroughly during its inactive state. As noted above, a very large value for the high pressure supply is used to provide a long supply of uniform pressure once the hermetical seat is broken and the invention is activated.

Figure 4:
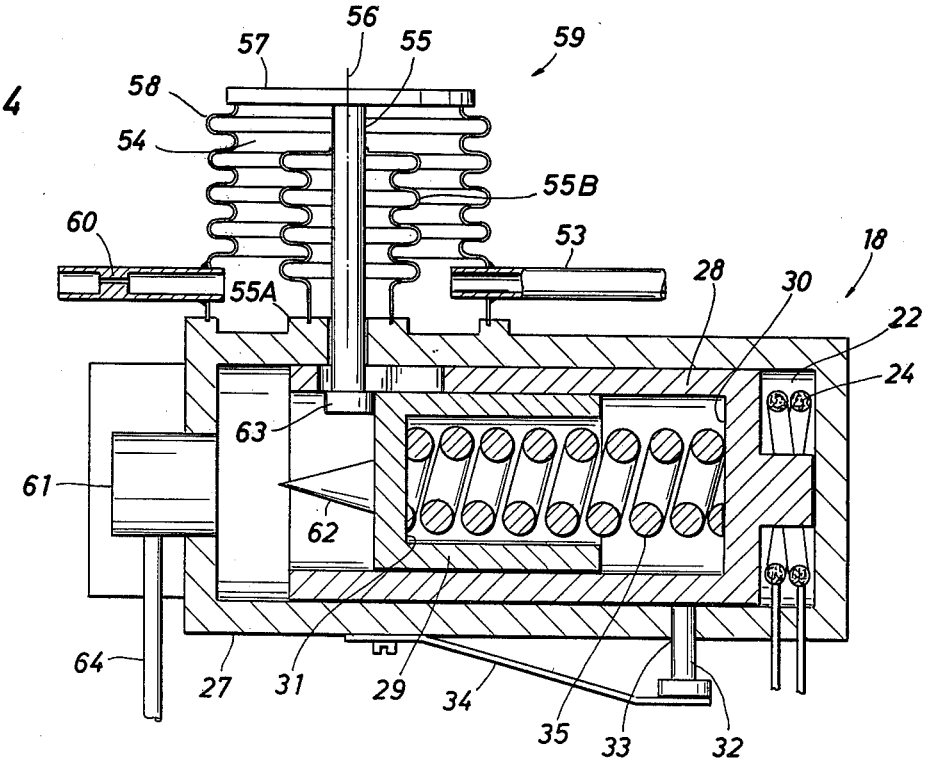

With respect to FIG. 4, the firing assembly 18 is illustrated with activation system 59 mounted atop.

Firing assembly 18 comprises an exterior housing 27 which supports a hollow sliding shaft 28. The firing piston 29 is laterally displacable within shaft 28. Upon detonation, a coil spring 35 advances firing piston 29 to the left detonating a stab primer 61.

The coil spring 35 is securely held in place by end wall 30 of the shaft 28 and wall 31 of the firing piston 29. A firing pin 62 is attached to wall 31 of firing piston 29. The stab primer 61 is located directly opposite the firing pin 62 attached to exterior housing 27. Pyro-conduit 64 is connected to the primer 61 and a rocket motor 65. A detent 32 is connected to a leaf spring 34 on the exterior surface of the housing 27. The detent 32 is laterally restrained by aperture 33 of housing 27. Similar to loop 23 within regulator 15, pyro-train 19 is looped within compartment 22 of firing assembly 18. Pyro-train 19 exits compartment 22 and continues on to compartment 41 of regulator 15. This section of pyro-train 19 between compartment 22 and compartment 41 is redundant and only necessary to ignite loop 23 (FIG. 3) if pyro-lead 25 fails to ignite.

The activation system 59 controls the sensitivity of the invention by determining the response time required to release the firing piston 29. A bellows housing 58 is mounted atop exterior housing 27. Activation conduit 53 is connected to the bellows housing 58 and the sensor valve 38. An activation piston 55 is located within bellows housing 58 and displaceable along axis 56. Flange 57 is mounted to the distal end of the piston 55 opposite exterior housing 27. Flange 57 is also attached to bellows 58. Piston 55 is laterally restrained by a base plate 55A which is attached to the exterior housing 27. A bellows 55B is mounted atop base plate 55A and prevents leakage of pneumatic pressure along the surface of piston 55. Detent 63 is attached to the base of piston 55 and prevents the lateral movement of firing piston 29 toward primer 61. An orifice 60 is attached to bellows housing 58 and is in communication with a chamber 54. Upon ignition of pyro-train 19, loop 24 advances shaft 28 to the left. The spring constant of the coiled spring 35 is small enough to allow the lateral displacement of the shaft 28. Once wall 30 of shaft 28 has passed aperture 33, detent 32 is free to pass through aperture 33 and enter compartment 22. In this manner, shaft 28 is prevented from returning to its original position. In addition, coil spring 35 is compressed between wall 30 which is restrained by detent 32 and wall 31 which is restrained by detent 63. Due to the firing velocity of the pyro-train, loops 23 and 24 ignite almost simultaneously. The priming stage which includes the engagement of shaft 28 and the fracture of hermetical seal 46 is multi-functional occurring very rapidly. In the prototype, all bellows were manufactured of metal for sealing purposes. Metal offers a particularly high leak resistance, low temperature sensitivity, long storage life and high nuclear radiation hardness.

In actual operation, the pyro-input 21 ignites all leads exiting from the pyro-manifold 20. With the simultaneous ignition of the pyro-leads 25 and 26, the shaft 28 of firing assembly 18 and the needle piston 39 of pressure regulator 15 are primed as discussed above. Coil spring 35 of firing assembly 18 is compressed ready for the release of detent 63 from firing piston 29. In addition, pressure within the bellows 42 of regulator 12 is equalized by the compressive force of coil spring 37 within pressure regulator 15. Whenever a differential drag force is sensed by the body 4 sufficient to overcome the compressive spring constant of dampening spring 14, the rod 11 is displaced from aperture 51 of sensor valve 38. Immediately, the equalized pneumatic pressure from bellows 42 escapes into compartment 52 of sensor 38. The pressure continues along activation conduit 53 into the chamber 54 of bellows housing 58. Orifice 60 allows the leakage of pressure from within compartment 54 at a specified rate. When a longterm differential force is sensed by body 4, a continuous supply of equalized pneumatic pressure is allowed to enter the chamber 54. Since the pressure entering from bellows 42 of regulator 15 is greater than the permissible rate of escape across the orifice, the pressure builds within the chamber 54. In this manner, the piston 55 is displaced. With the displacement of piston 55 along axis 56, detent 63 is displaced thereby allowing the firing piston 29 free access to the primer 61. As the pressure within bellows 42 decreases, spring 37 displacees needle piston 39 to the left thereby releasing additional pressure from source 45 into the compartment 16. The pressure rapidly migrates to the bellows 42 wherein it exists via aperture 51 into compartment 52 of sensor valve 38. By choosing a specific spring constant for dampening spring 14, the magnitude of force required to displace body 4 is determinable. Similarly, by varying the size of orifice 60 and the chamber 54 and the spring constant of spring 37 within regulator 15, the response time requested to release the firing piston 29 is determined. The diameter of the orifice 60 and the dimensions of the chamber 54 dictate the level of pressure required to displace piston 55 whereas the force exerted by spring 37 determines the uniform pressure leaving regulator 15. Applicant illustrates the ignition of rocket motor 65; however, pyro-conduit 64 may ignite controls which ascend or descend a craft, discharge explosive bolts, release "cable cutters", or any number of related activities.

Figure 5:
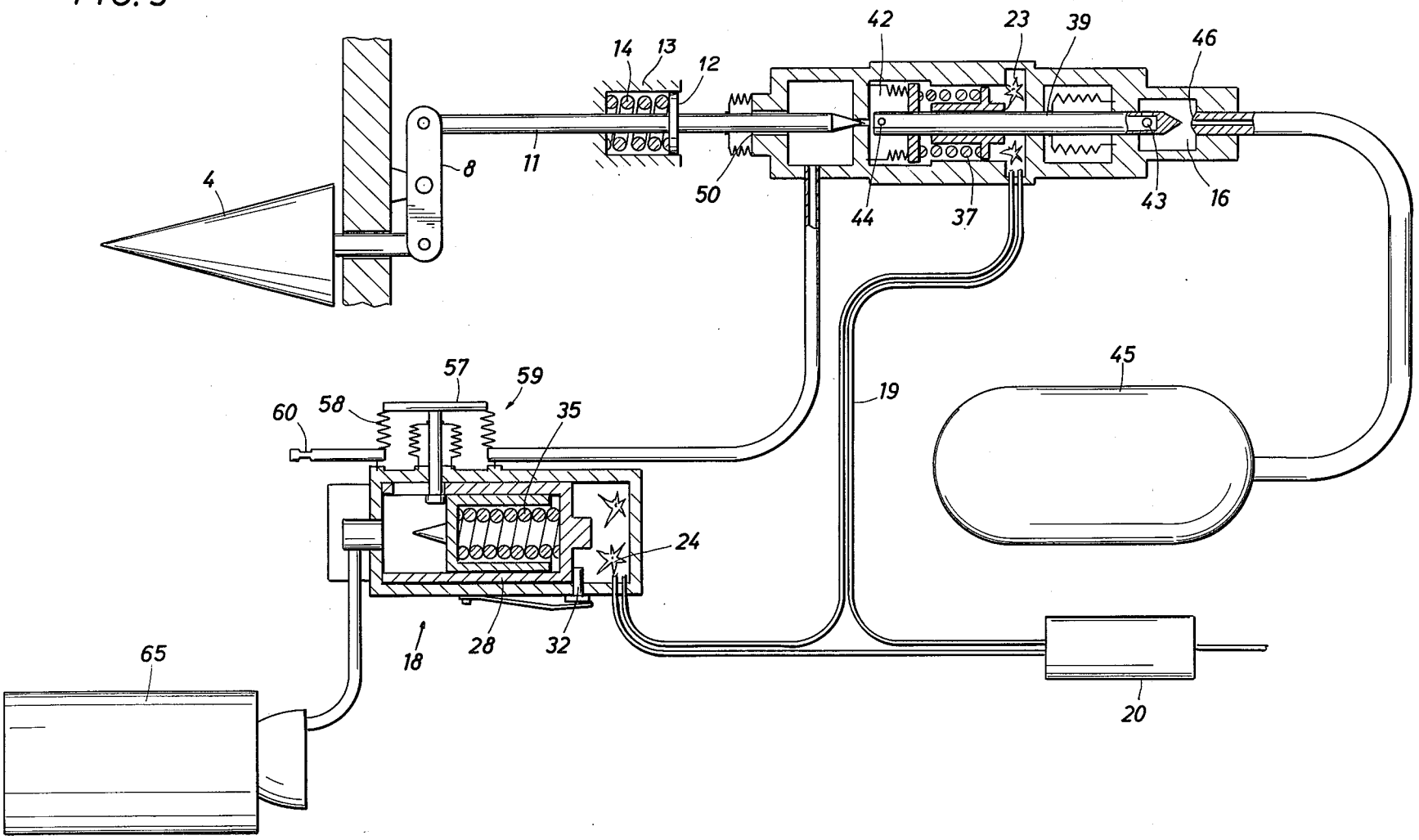
Figure 6:
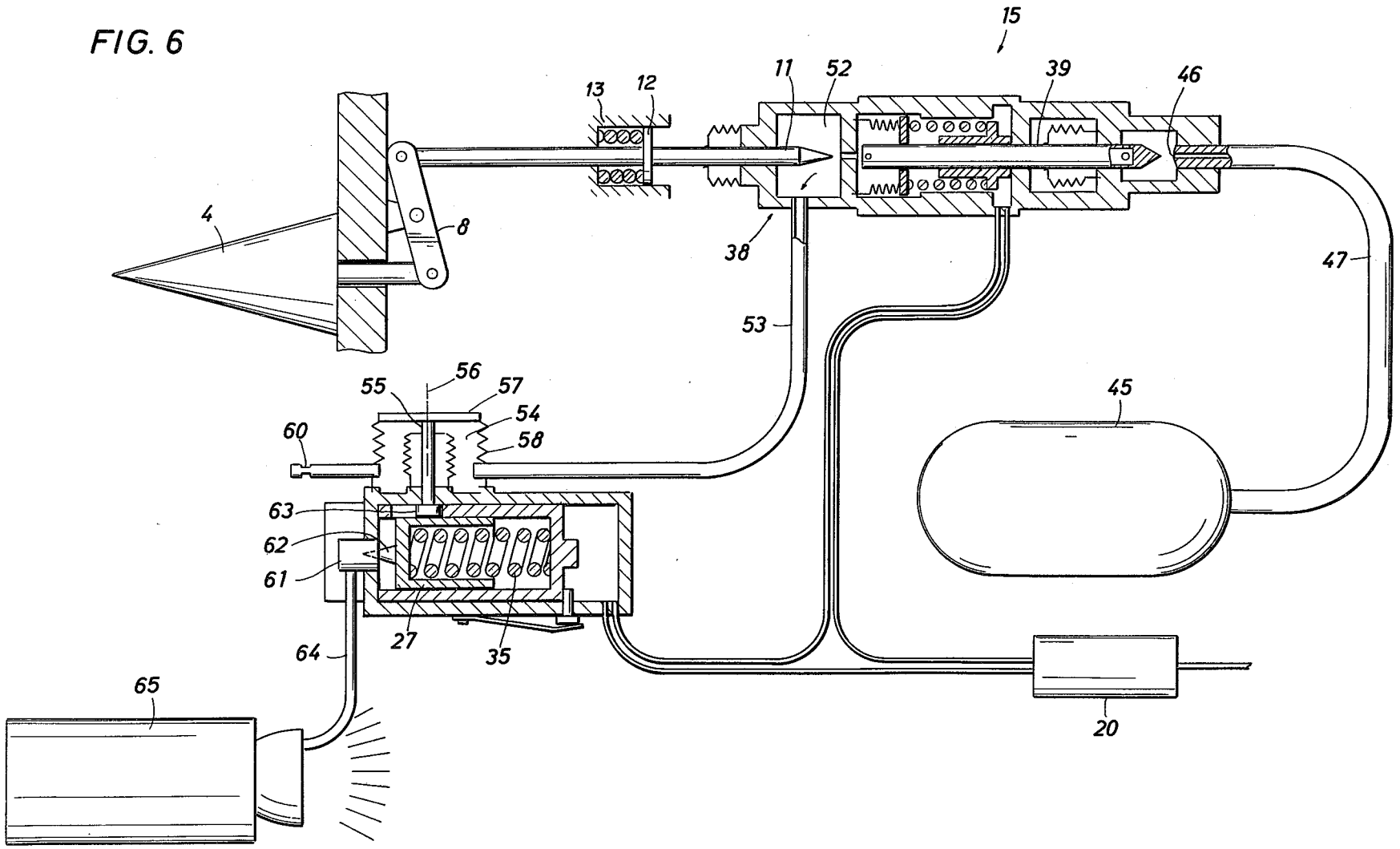

The location of the firing piston 29 within firing assembly 18 and needle piston 39 within pressure regulator 15 is shown in a primed and engaged position in FIG. 5. Detent 32 has passed through aperture 33 of housing 27 and is restraining shaft 28 from returning to its original position. Needle piston 39 is displaced to the left thereby breaking the air-tight seal between needle piston 39 and seal 46. At this point, high pneumatic pressure is entering compartment 16 and passing along the interior of needle piston 39 via holes 43 and 44 into equalizing bellows 42. FIG. 6 illustrates the flow of equalized air pressure from sensor valve 38 into bellows housing 58. When the predetermined magnitude of differential drag is sensed by body 4, the rod 11 is laterally displaced allowing equalized or uniformed air pressure from bellows 42 to migrate through aperture 51 into compartment 52 of valve sensor 38. Immediately, the pressure enters activation conduit 53 and progresses to the chamber 54 of bellows housing 58. If the rate of air pressure entering the chamber 54 from activation conduit 53 exceeds the maximum allowable flow rate across orifice 60, the air pressure within the chamber 54 begins to rise. As the pressure rises, the force exerted on flange 57 of piston 55 increases. If the air pressure force continues for the predetermined time span reaching the predetermined pressure level, bellows 58 expands displacing piston 55 along axis 56. With the displacement of piston 55, restraining detent 63 is also displaced. In this manner, firing piston 29 which restrains spring 35 in compression is free to advance forward detonating stab primer 61 with firing pin 62. Pyro-conduit 64 is immediately ignited by the detonation of primer 61. As illustrated in FIG. 6, pyroconduit 64 ignites rocket motor 65; however, pyro-conduit 64 may ignite any number of related activities. Additionally, a plurality of pyro-conduits 64 may be ignited from detonation of primer 61. In this manner, any number of related activities may be ignited simultaneously.

Thus, it is apparent that there has been provided, in accordance with applicant's invention, an efficient and reliable method and apparatus for detecting differential drag forces and relaying an activation signal which results in the performance of a specified activity. The invention, therefore, specifically satisfies the objectives and advantages set forth above. Although the invention has been defined in conjunction with specific forms thereof, it is evident that many alternatives, modifications, and variations will be apparent to those skilled in the art in light of the foregoing disclosure. Accordingly, it is intended that all such alternatives, modifications, and variations which fall within the spirit and scope of the invention as defined in the appended claims be embraced thereby.

What we claim is:

1. A differential drag force apparatus to detect air pressure forces on an object moving through the air, and for initiating a signal in response to sustained drag forces of a predetermined magnitude, the apparatus having a source of high pressure fluid, the apparatus comprising:

(a) a drag-sensing body, for sensing air pressure drag forces caused by movement of said body through the air, said body moving relative to the object in response to drag forces of a predetermined magnitude;

(b) a pressure regulator connected to the source of high pressure fluid, for controllably releasing pressurized fluid from the source in response to the relative movement of the body;

(c) an activation system, for enabling the generation of the signal when the drag forces on said body have reached a predetermined magnitude for a predetermined length of time, said system including an activation chamber having a pressure inlet for receiving the pressurized fluid, and a restrictive pressure outlet for permitting the pressure from within the activation chamber to escape, the generation of the signal being enabled when the sustained pressure within the activation chamber reaches a predetermined level; and (d) a trigger activated by the activation system, for initiating the signal.

2. The apparatus according to claim 1 further comprising a dampening spring to preclude the relative movement of the body when the drag force is below the predetermined magnitude.

3. The apparatus according to claim 1 which further comprises a priming system to cock the trigger and activate the pressure regulator.

4. The apparatus according to claim 1 wherein the trigger comprises a spring-biased firing assembly.

5. The apparatus according to claim 1 wherein the activation chamber comprises a bellows having an activation piston displaceably mounted within the bellows to release the trigger when said bellows expands due to the uniform pressure received from the pressure regulator.

6. The apparatus according to claim 5 wherein the pressure restrictive outlet comprises an orifice to release pressure from within the bellows at a predetermined rate.

7. The apparatus according to claim 5 or claim 4 wherein the firing assembly comprises:

(a) an exterior housing;

(b) a hollow shaft enclosed within the exterior housing and longitudinally displaceable within the housing;

(c) a firing piston laterally displaceable within the hollow shaft;

(d) a coil spring in contact with said hollow shaft and the firing piston, the spring compressible between the hollow shaft and said firing pistons; and (e) means for initiating the signal in response to lateral displacement of the firing piston, said firing piston released for lateral displacement by said activation system when the sustained pressure within the activation chamber reaches a predetermined level.

8. The apparatus according to claim 1 wherein the pressure regulator includes:

(a) a regulating chamber connected to the activation system chamber, the output of the regulating chamber being a regulated source of pressure to the activation system chamber; and (b) a sealing assembly connected between the source and said regulating chamber, for sealing off an input port through which the pressurized fluid from the source enters said regulating chamber, said sealing assembly opening to permit pressurized fluid from the source to enter said regulating chamber when the pressure in said regulating chamber is less than the pressure in the source.

9. The apparatus according to claim 8 wherein the sealing assembly includes a hermetical seal to preclude flow of high pressure fluid from the source into the regulating chamber while the apparatus is inactive.

10. The apparatus according to claim 9 wherein the pressure regulator further includes means responsive to an activation signal, for breaking the hermetical seal to permit the flow of high pressure fluid from the source into the regulating chamber when the uniform pressure within the regulating chamber decreases below the pressure in the source.

11. The apparatus according to claim 10 wherein said sealing assembly further includes a needle piston, having a proximal and distal end, supported in said regulating chamber at the proximal end and sealing off the input port at the distal end, the needle piston sealing the input port when in a first position with the distal end against the input port and permitting the high pressure fluid to enter the regulating chamber when the needle piston is laterally displaced to a second position due to the decrease in uniform pressure within the regulating chamber to a pressure below the pressure in the source.

12. A differential drag force apparatus for detecting air pressure forces on an object moving through the air and for initiating a signal when exposed to a sustained air pressure force of a predetermined magnitude, the apparatus including a supply of pressurized fluid, the apparatus comprising:

(a) a sensor means including a drag-sensing body to detect a differential drag force of a predetermined magnitude, the body responding to the drag force by relative movement of the body with respect to the object;

(b) a pressure regulator responsive to the relative movement of the body, for regulating the pressurized fluid, the regulator including, (i) a regulating chamber, and (ii) a sealing means for sealing off the supply of pressurized fluid from the regulating chamber, said sealing means opening to permit pressurized fluid from the supply to enter said regulating chamber when the pressure in said regulating chamber is less than the pressure in the supply;

(c) a trigger having a spring-biased firing assembly, for initiating the signal;

(d) an activation system responsive to said pressure regulator, for enabling the firing assembly to initiate the signal, said system having, (i) a bellows, for receiving the regulated pressure from said regulator, (ii) an orifice, for permitting the pressurized fluid within the bellows to escape at a predetermined rate, and (iii) an activation piston displaceably contained within said bellows, said piston displaced to an enabling position when the uniform pressure within the bellows reaches a predetermined level, thereby enabling said trigger to initiate the signal; and (e) a priming system to cock the firing assembly and to initiate the operation of said regulator.

13. A method for detecting differential drag forces and initiating a signal when exposed to a sustained air pressure force of a predetermined magnitude, said method comprising:

placing in the air stream a body which will respond by movement to an air pressure force of a predetermined magnitude;

releasing a uniform pressure gas in response to the movement of the body into a chamber that has a restricted outlet;

sensing the pressure level within the chamber as the gas is allowed to escape through the restricted outlet at a predetermined rate; and initiating a signal when the pressure level within the chamber exceeds a predetermined level.

* * * * *